US011927350B2

(12) United States Patent
Nation et al.

(10) Patent No.: US 11,927,350 B2
(45) Date of Patent: Mar. 12, 2024

(54) INDEPENDENT TEMPERATURE CONTROL FOR ROOMS

(71) Applicant: FIRST CO., Dallas, TX (US)

(72) Inventors: Greg Nation, Dallas, TX (US); Brent Sturgell, Forney, TX (US); Andres Canales, Dallas, TX (US)

(73) Assignee: FIRST CO., Dallas, TX (US)

( * ) Notice: Subject to any disclaimer, the term of this patent is extended or adjusted under 35 U.S.C. 154(b) by 0 days.

(21) Appl. No.: 18/323,097

(22) Filed: May 24, 2023

(65) Prior Publication Data

US 2023/0296267 A1 Sep. 21, 2023

Related U.S. Application Data

(63) Continuation of application No. 17/704,599, filed on Mar. 25, 2022, now Pat. No. 11,662,104.

(60) Provisional application No. 63/166,349, filed on Mar. 26, 2021.

(51) Int. Cl.

| | |
|---|---|
| ***F24F 1/028*** | (2019.01) |
| ***F24F 1/02*** | (2019.01) |
| ***F24F 11/70*** | (2018.01) |
| ***F25B 5/02*** | (2006.01) |
| *F24F 3/06* | (2006.01) |
| *F24F 13/02* | (2006.01) |

(52) U.S. Cl.
CPC ..... *F24F 1/028* (2019.02); *F24F 11/70* (2018.01); *F24F 1/02* (2013.01); *F24F 3/065* (2013.01); *F24F 13/0272* (2013.01); *F24F 2221/36* (2013.01); *F25B 5/02* (2013.01); *F25B 2400/07* (2013.01)

(58) Field of Classification Search
CPC .... F24F 3/065; F24F 13/0272; F24F 2221/36; F24F 1/02; F25B 5/02; F25B 6/02
See application file for complete search history.

(56) References Cited

U.S. PATENT DOCUMENTS

| | | | | |
|---|---|---|---|---|
| 6,672,089 | B2 * | 1/2004 | Park | F25B 41/20 62/157 |
| 2015/0013356 | A1 * | 1/2015 | Karkhanis | F24F 11/46 62/90 |
| 2019/0154321 | A1 * | 5/2019 | Takenaka | F25B 47/022 |

* cited by examiner

*Primary Examiner* — Lionel Nouketcha
(74) *Attorney, Agent, or Firm* — HAYNES AND BOONE, LLP

(57) ABSTRACT

Providing simultaneous independent temperature control of conditioned air to first and second rooms. First and second evaporators may be positioned so that: air from the first room passes through the first evaporator before exhausting back to the first room; and air from the second room passes through the second evaporator before exhausting back to the second room.

20 Claims, 5 Drawing Sheets

INDEPENDENT TEMPERATURE CONTROL FOR ROOMS

CROSS-REFERENCE TO RELATED APPLICATIONS

This application is a continuation of U.S. patent application Ser. No. 17/704,599, filed Mar. 25, 2022, which claims the benefit of the filing date of, and priority to, U.S. Patent Application No. 63/166,349, filed Mar. 26, 2021, the entire disclosures of which are hereby incorporated herein by reference.

BACKGROUND

The present application relates generally to temperature control for rooms and, more particularly, to a temperature control ("TC") unit and associated method for providing simultaneous independent temperature control of conditioned air to first and second rooms.

DETAILED DESCRIPTION

Figure 1:
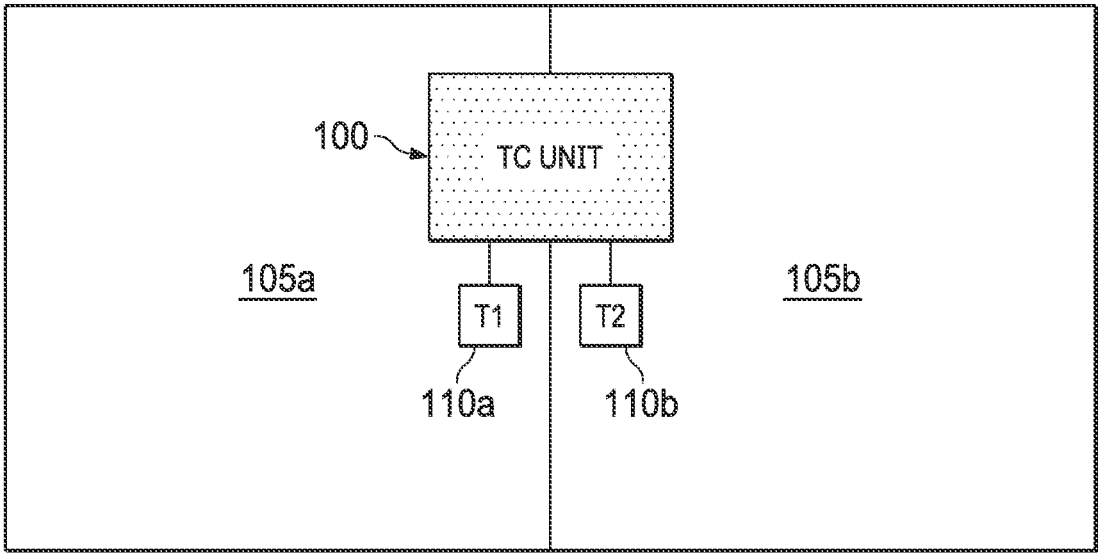
FIG. 1 is a diagrammatic illustration of a temperature control unit providing simultaneous temperature control to adjacent first and second rooms, according to one or more embodiments.

Referring to FIG. 1, in an embodiment, a single temperature control ("TC") unit 100 provides simultaneous temperature control for rooms 105*a* and 105*b*, wherein the temperature for the room 105*a* is independent of the temperature for the room 105*b*. As a result, the TC unit 100 is capable of: heating the room 105*a* while cooling the room 105*b*; heating the room 105*a* while also heating the room 105*b*; cooling the room 105*a* while heating the room 105*b*; and cooling the room 105*a* while also cooling the room 105*b*. In one or more embodiments, the TC unit 100 is self-contained in a single cabinet 180 (detail shown in FIG. 3B). A temperature interface 110*a* is used to communicate to the TC unit 100 the desired temperature of the room 105*a*, causing the TC unit 100 to provide conditioned air to the room 105*a*. Similarly, a temperature interface 110*b* is used to communicate to the TC unit 100 the desired temperature of the room 105*b*, causing the TC unit 100 to provide conditioned air to the room 105*b*. In one or more embodiments, the temperature of the room 105*b* is different than the temperature of the room 105*a*. Accordingly, the temperature of the conditioned air provided to the room 105*b* is different from the temperature of the conditioned air provided to the room 105*a*. The temperature interfaces 110*a* and 110*b* are independently adjustable by occupant(s) of the rooms 105*a* and 105*b*, respectively. The rooms 105*a* and 105*b* may be adjacent (as shown in FIG. 1) or non-adjacent rooms. For example, the rooms 105*a* and 105*b* may be adjacent hotel/motel rooms, adjacent assisted-living dwelling spaces, adjacent hospital rooms, adjacent student dormitory rooms, etc.

Figure 2A:
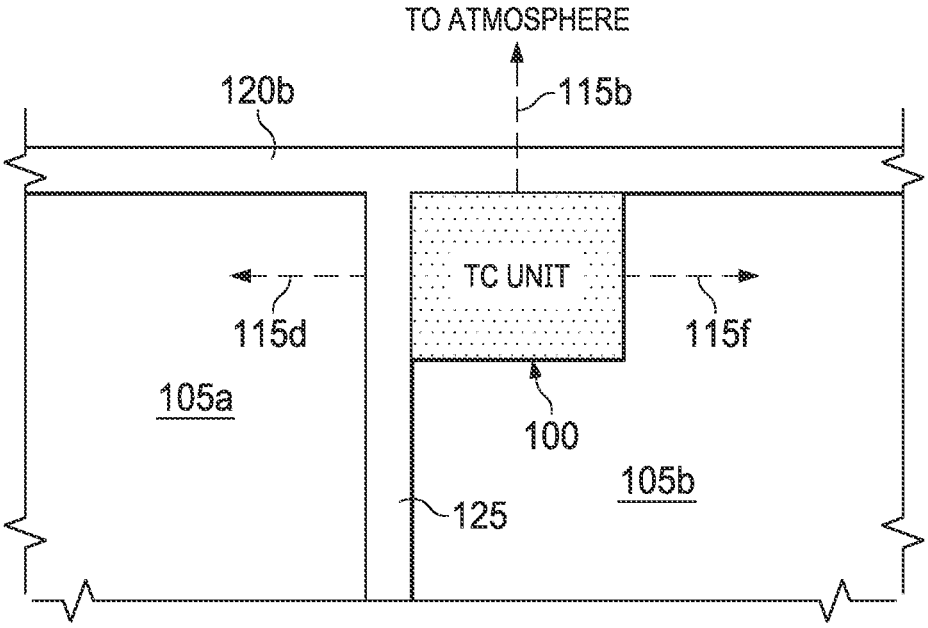
FIG. 2A is a top diagrammatic illustration of a temperature control unit positioned against an exterior wall extending between a second room and atmosphere, and against an interior wall extending between the second room and a first room adjacent the second room, according to one or more embodiments.
Figure 2B:
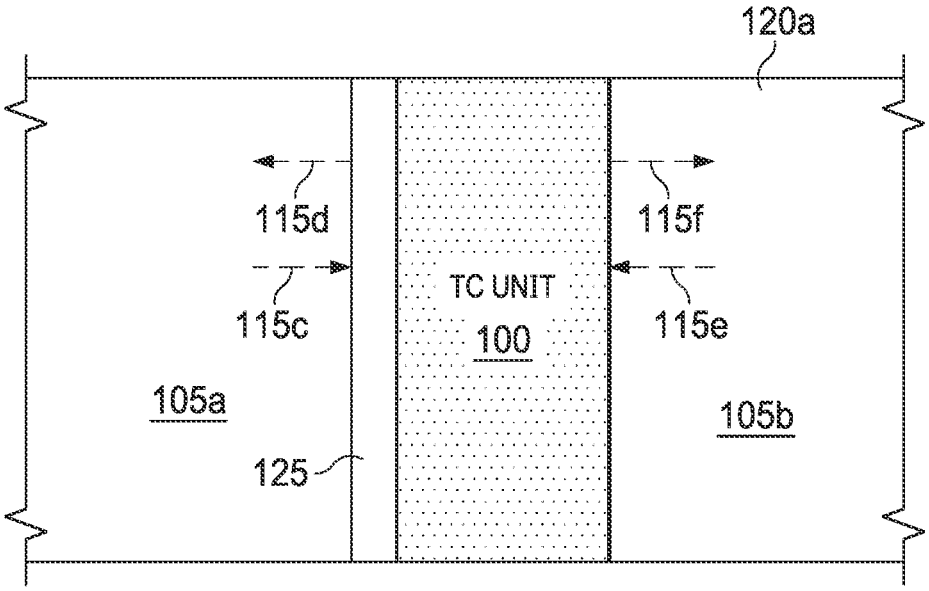
FIG. 2B is a front diagrammatic illustration of the temperature control unit, the first room, the second room, the interior wall, and the exterior wall of FIG. 2A, according to one or more embodiments.
Figure 2C:
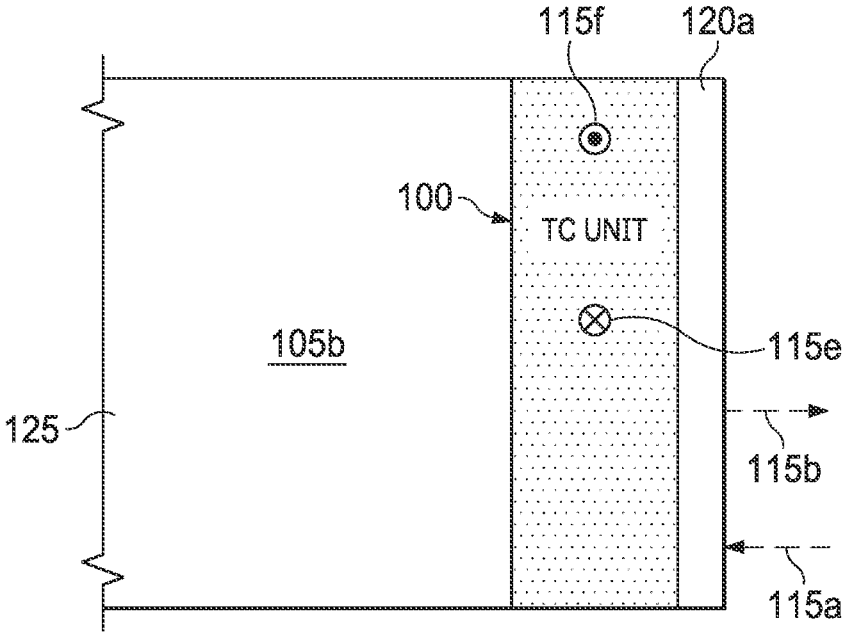
FIG. 2C is a right side diagrammatic illustration of the temperature control unit, the second room, the interior wall, and the exterior wall of FIG. 2A, according to one or more embodiments.
Figure 2D:
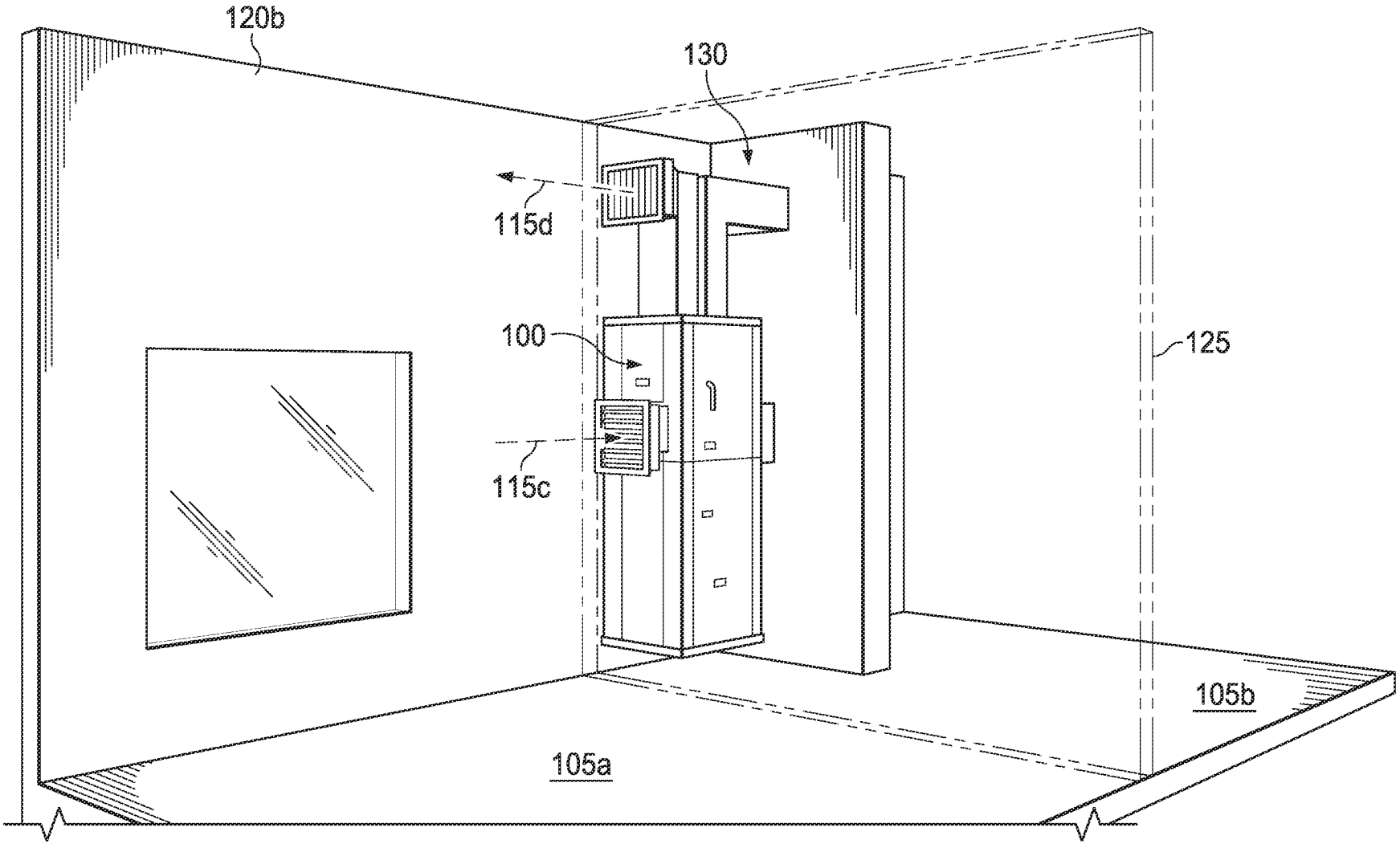
FIG. 2D is a perspective view of the temperature control unit, the first room, the second room, the interior wall, and the exterior wall of FIG. 2A, the second room including a closet in which the temperature control unit is positioned, according to one or more embodiments.

Referring to FIGS. 2A-2D, with continuing reference to FIG. 1, in an embodiment, the TC unit 100 receives atmospheric air 115*a* via, for example, first ductwork, and exhausts air 115*b* back to atmosphere via, for example, second ductwork (as shown in FIGS. 2A and 2C). Moreover, the TC unit 100 receives air 115*c* from the room 105*a* via, for example, third ductwork, and exhausts conditioned air 115*d* back to the room 105*a* via, for example, fourth ductwork, (as shown in FIGS. 2A, 2B, and 2D). Likewise, the TC unit 100 receives air 115*e* from the room 105*b* via, for example, fifth ductwork, and exhausts conditioned air 115*f* back to the room 105*b* via, for example, sixth ductwork (as shown in FIGS. 2A-2C). In one or more embodiments, as in FIGS. 2A-2D, the TC unit 100 is positioned entirely within the room 105*b*; for example, the TC unit 100 may be positioned against an exterior wall 120*a* extending between the room 105*b* and atmosphere. In one or more alternative embodiments, the TC unit 100 is positioned entirely within the room 105*a*; for example, the TC unit 100 may be positioned against an exterior wall 120*b* extending between the room 105*a* and atmosphere. In addition, or instead, the TC unit 100 may be positioned against an interior wall; if the rooms 105*a* and 105*b* are adjacent rooms, the interior wall against which the TC unit 100 is positioned may be an interior wall 125 extending between the rooms 105*a* and 105*b*. In one or more embodiments, as in FIG. 2D, the TC unit 100 is positioned within a closet 130 in the room 105*b*.

Additionally, or alternatively, the TC unit 100 may receive heat transfer medium (e.g., water) from a fluid source (e.g., a geothermal fluid source) and exhaust the heat transfer medium back to the fluid source. In such embodiment(s), the fluid source may supply heat transfer medium to the TC unit 100 and one or more other TC units substantially identical to the TC unit 100. In one or more embodiments, the interior wall against which the TC unit 100 is positioned may be or include another interior wall extending between: the room 105*a* and a hallway (not shown); or the room 105*b* and the hallway. In such embodiment(s), the TC unit 100 may: receive air from another air source (e.g., the hallway) and exhaust air back to the another air source; receive heat transfer medium from the fluid source and exhaust the heat transfer medium back to the fluid source; or both.

Figure 3A:
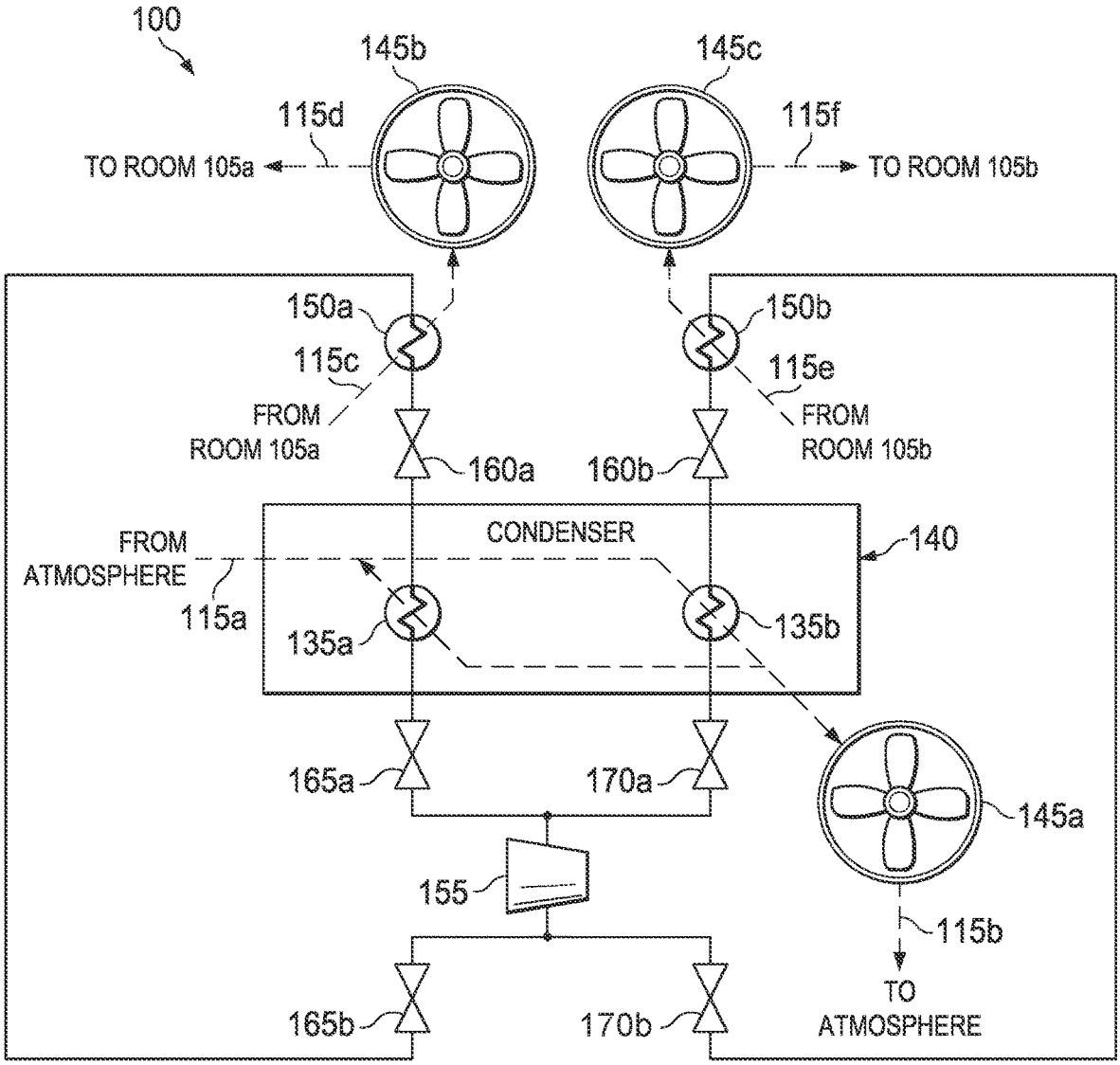
FIG. 3A is a diagrammatic illustration of a temperature control unit, according to one or more embodiments.
Figure 3B:
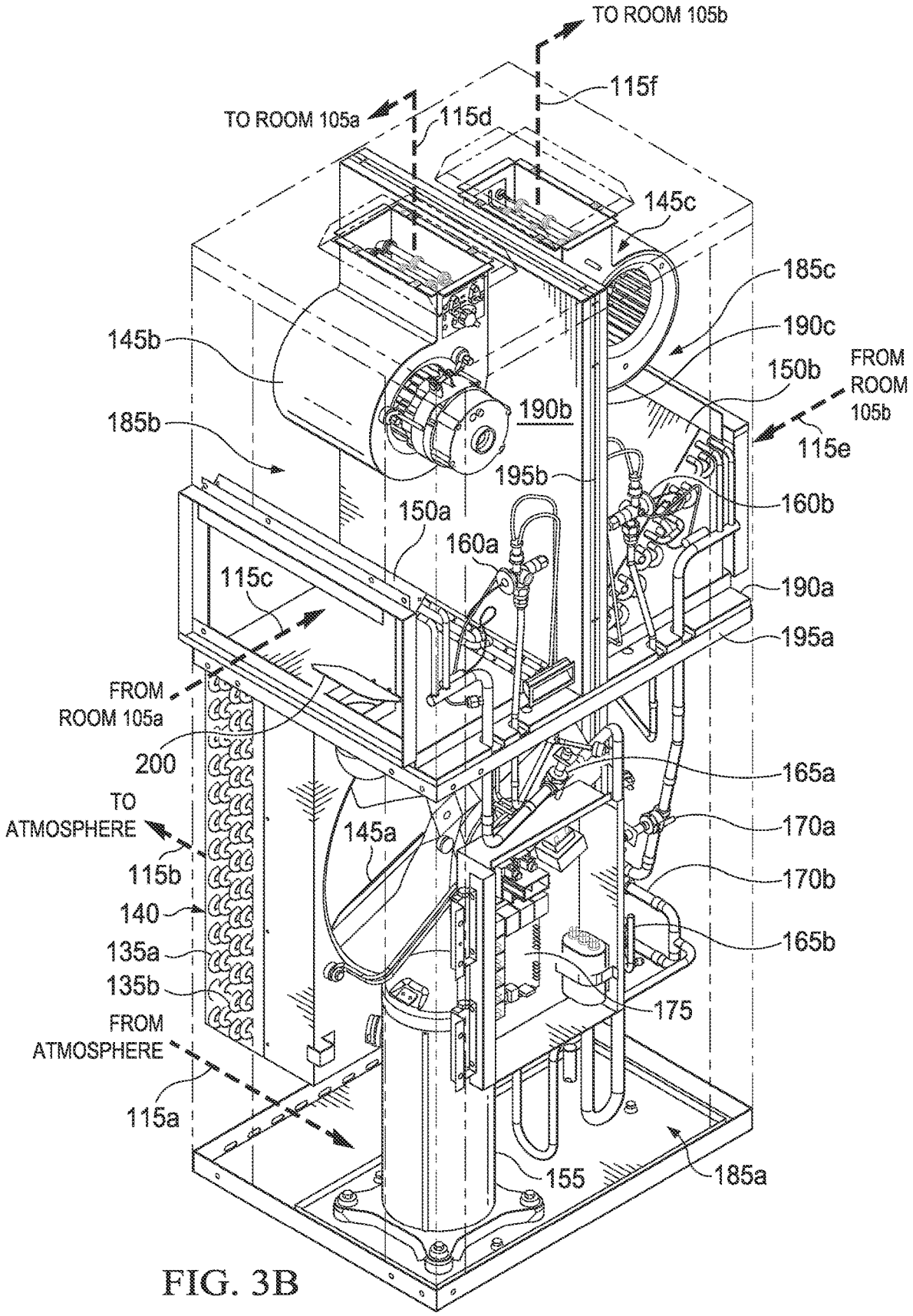
FIG. 3B is a perspective view of the temperature control unit of FIG. 3A, according to one or more embodiments.

Referring to FIGS. 3A and 3B, with continuing reference to FIGS. 1 and 2A-2D, in an embodiment, the atmospheric air 115*a* received by the TC unit 100 and exhausted back to atmosphere (as indicated by arrow 115*b*) is conveyed through circuits 135*a* and 135*b* of a condenser 140; for example, an air mover 145*a* may urge the air 115*a* received from atmosphere through the circuits 135*a* and 135*b* of the condenser 140 (via, for example, the first ductwork). The air conveyed through the circuits 135*a* and 135*b* of the condenser 140 is utilized to heat or cool heat transfer medium also conveyed through the circuits 135*a* and 135*b* of the condenser 140, as will be described in further detail below, before being conveyed back to atmosphere, as indicated by arrow 115*b* (via, for example, the second ductwork). The air 115*c* received from the room 105*a* and exhausted back to the room 105*a* (as indicated by arrow 115*d*) is conveyed through an evaporator 150*a*; for example, an air mover 145*b* may urge the air 115*c* received from the room 105*a* (optionally, in addition to at least a portion of the atmospheric air 115*a*) through the evaporator 150*a* (via, for example, the third ductwork) and back to the room 105*a* (via, for example, the fourth ductwork). The heat transfer medium from the circuit 135*a* of the condenser 140 is also conveyed through the evaporator 150*a* to heat or cool the air conveyed through the evaporator 150*a*. Similarly, the air 115*e* received from the room 105*b* and exhausted back to the room 105*b* (as indicated by arrow 115*f*) is conveyed through an evaporator 150*b*; for example, an air mover 145*c* may urge the air 115*e* received from the room 105*b* (optionally, in addition to at least a portion of the atmospheric air 115*a*) through the evaporator 150*b* (via, for example, the fifth ductwork) and back to the room 105*b* (via, for example, the sixth ductwork). The heat transfer medium from the circuit 135*b* of the condenser 140 is also conveyed through the evaporator 150*b* to heat or cool the air conveyed through the evaporator 150*b*.

A compressor 155 circulates the heat transfer medium through the condenser 140, including the circuits 135*a* and 135*b*, through expansion valves 160*a* and 160*b*, and through the evaporators 150*a* and 150*b*. To allow for independent temperature control of the rooms 105*a* and 105*b*: the circulation of the heat transfer medium through the circuit 135*a* of the condenser 140 and the evaporator 150*a* can be cut off or otherwise adjusted by circulation valves 165*a* and 165*b* (e.g., solenoid valves); the circulation of the heat transfer medium through the circuit 135*a* of the condenser 140 and the evaporator 150*a* can be reversed; the circulation of the heat transfer medium through the circuit 135*b* of the condenser 140 and the evaporator 150*b* can be cut off, reversed, or otherwise adjusted by closing circulation valves 170*a* and 170*b* (e.g., solenoid valves); the circulation of the heat transfer medium through the circuit 135*b* of the condenser 140 and the evaporator 150*b* can be reversed; or any combination thereof.

In one or more embodiments, the TC unit 100 is or includes a vertical terminal air conditioner ("VTAC") unit.

Turning specifically to FIG. 3B, with continuing reference to FIG. 3A, in an embodiment, the TC unit 100 includes a control unit 175 that communicates control signals to: the compressor 155; the air mover 145*a*; the circulation valves 165*a* and 165*b*; the air mover 145*b*; the circulation valves 170*a* and 170*b*; the air mover 145*c*; or any combination thereof. In one or more embodiments, the control unit 175 also communicates control signals to the expansion valves 160*a* and 160*b*. The TC unit 100 includes a cabinet 180 divided in three (3) separate compartments 185*a*, 185*b*, and 185*c*. The compartment 185*a* extends along a bottom portion of the cabinet 180 and houses the control unit 175, the compressor 155, the circulation valves 165*a* and 165*b*, the circulation valves 170*a* and 170*b*, the air mover 145*a*, and the condenser 140, including the circuits 135*a* and 135*b*. Sound dampening insulation 190*a* is positioned against a wall 195*a* (e.g., a horizontal wall) separating the compartment 185*a* from the compartments 185*b* and 185*c*.

The compartment 185*b* extends along a top portion of the cabinet 180 (on one side) and houses the expansion valve 160*a*, the evaporator 150*a*, and the air mover 145*b*. Sound dampening insulation 190*b* is positioned against a wall 195*b* (e.g., a vertical wall) separating the compartment 185*b* from the compartment 185*c*. A vent 200 is formed through a portion of the wall 195*a* separating the compartment 185*b* from the compartment 185*a*, which vent 200 selectively permits: atmospheric air from the compartment 185*a* to combine with air 115*c* received from the room 105*a* in the compartment 185*b* before being conveyed through the evaporator 150*a*; air 115*c* received from the room 105*a* into the compartment 185*b* to combine with the atmospheric air in the compartment 185*a*; or both. In one or more embodiments, the control unit 175 also communicates control signals to the vent 200 to control opening and closing of the vent 200.

Similarly, the compartment 185*c* extends along the top portion of the cabinet 180 (on the other side) and houses the expansion valve 160*b*, the evaporator 150*b*, and the air mover 145*c*. Sound dampening insulation 190*c* is positioned against the wall 195*b* separating the compartment 185*c* from the compartment 185*b*. Another vent (not visible in FIG. 3B; substantially identical to the vent 200), is formed through a portion of the wall 195*a* separating the compartment 185*c* from the compartment 185*a*, which another vent selectively permits: atmospheric air from the compartment 185*a* to combine with air 115*e* received from the room 105*b* in the compartment 185*c* before being conveyed through the evaporator 150*b*; air 115*e* received from the room 105*b* into the compartment 185*c* to combine with the atmospheric air in the compartment 185*a*; or both. In one or more embodiments, the control unit 175 also communicates control signals to the another vent to control opening and closing of the another vent.

Figure 4:
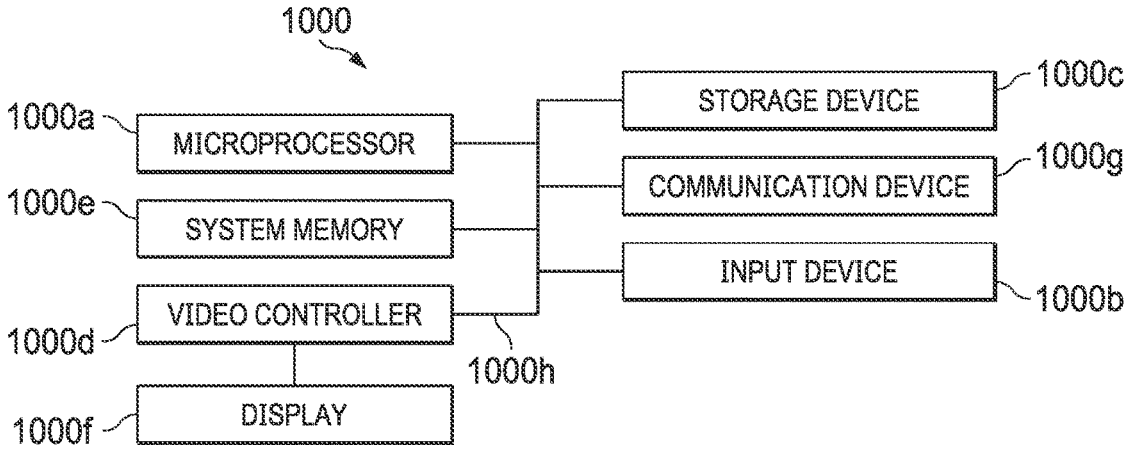
FIG. 4 is a diagrammatic illustration of a computing node for implementing one or more embodiments of the present disclosure.

Referring to FIG. 4, with continuing reference to FIGS. 1, 2A, 2B, 2C, 2D, 3A, and 3B, in one or more embodiments, a computing node 1000 for implementing one or more embodiments of one or more of the above-described element(s), component(s), system(s), apparatus, method(s), step(s), and/or control unit(s) (such as, for example, the control unit 175 shown and described in connection with FIG. 3B), and/or any combination thereof, is depicted. The node 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In one or more embodiments, the microprocessor 1000*a* is, includes, or is part of, the controller 180 and/or the one or more other controllers described herein. In one or more embodiments, the storage device 1000*c* may include a floppy drive, hard drive, CD-ROM, optical drive, any other form of storage device or any combination thereof. In one or more embodiments, the storage device 1000*c* may include, and/or be capable of receiving, a floppy disk, CD-ROM, DVD-ROM, or any other form of computer-readable medium that may contain executable instructions. In one or more embodiments, the communication device 1000*g* may include a modem, network card, or any other device to enable the node 1000 to communicate with other nodes. In one or more embodiments, any node represents a plurality of interconnected (whether by intranet or Internet) computer systems, including without limitation, personal computers, mainframes, PDAs, smartphones and cell phones.

In one or more embodiments, one or more of the components of any of the above-described systems include at least the node 1000 and/or components thereof, and/or one or more nodes that are substantially similar to the node 1000 and/or components thereof. In one or more embodiments, one or more of the above-described components of the node 1000 and/or the above-described systems include respective pluralities of same components.

In one or more embodiments, a computer system typically includes at least hardware capable of executing machine readable instructions, as well as the software for executing acts (typically machine-readable instructions) that produce a desired result. In one or more embodiments, a computer system may include hybrids of hardware and software, as well as computer sub-systems.

In one or more embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In one or more embodiments, hardware may include any physical device that is capable of storing machine-readable instructions, such as memory or other data storage devices. In one or more embodiments, other forms of hardware include hardware sub-systems, including transfer devices such as modems, modem cards, ports, and port cards, for example.

In one or more embodiments, software includes any machine code stored in any memory medium, such as RAM or ROM, and machine code stored on other devices (such as floppy disks, flash memory, or a CD ROM, for example). In one or more embodiments, software may include source or object code. In one or more embodiments, software encompasses any set of instructions capable of being executed on a node such as, for example, on a client machine or server.

In one or more embodiments, combinations of software and hardware could also be used for providing enhanced functionality and performance for certain embodiments of the present disclosure. In one or more embodiments, software functions may be directly manufactured into a silicon chip. Accordingly, combinations of hardware and software are also included within the definition of a computer system and are thus envisioned by the present disclosure as possible equivalent structures and equivalent methods.

In one or more embodiments, computer readable mediums include, for example, passive data storage, such as a random-access memory (RAM) as well as semi-permanent data storage such as a compact disk read only memory (CD-ROM). One or more embodiments of the present disclosure may be embodied in the RAM of a computer to transform a standard computer into a new specific computing machine. In one or more embodiments, data structures are defined organizations of data that may enable one or more embodiments of the present disclosure. In one or more embodiments, data structure may provide an organization of data, or an organization of executable code.

In one or more embodiments, any networks and/or one or more portions thereof, may be designed to work on any specific architecture. In one or more embodiments, one or more portions of any networks may be executed on a single computer, local area networks, client-server networks, wide area networks, internets, hand-held and other portable and wireless devices and networks.

In one or more embodiments, database may be any standard or proprietary database software. In one or more embodiments, the database may have fields, records, data, and other database elements that may be associated through database specific software. In one or more embodiments, data may be mapped. In one or more embodiments, mapping is the process of associating one data entry with another data entry. In one or more embodiments, the data contained in the location of a character file can be mapped to a field in a second table. In one or more embodiments, the physical location of the database is not limiting, and the database may be distributed. In one or more embodiments, the database may exist remotely from the server, and run on a separate platform. In one or more embodiments, the database may be accessible across the Internet. In one or more embodiments, more than one database may be implemented.

In one or more embodiments, a plurality of instructions stored on a non-transitory computer readable medium may be executed by one or more processors to cause the one or more processors to carry out or implement in whole or in part the above-described operation of each of the above-described element(s), component(s), system(s), apparatus, method(s), step(s), and/or control unit(s) (such as, for example, the control unit 175 shown and described in connection with FIG. 3B), and/or any combination thereof. In one or more embodiments, such a processor may be or include one or more of the microprocessor 1000*a*, one or more control units (such as, for example, the control unit 175 shown and described in connection with FIG. 3B), one or more other controllers, any processor(s) that are part of the components of the above-described systems, and/or any combination thereof, and such a computer readable medium may be distributed among one or more components of the above-described systems. In one or more embodiments, such a processor may execute the plurality of instructions in connection with a virtual computer system. In one or more embodiments, such a plurality of instructions may communicate directly with the one or more processors, and/or may interact with one or more operating systems, middleware, firmware, other applications, and/or any combination thereof, to cause the one or more processors to execute the instructions.

A first temperature control ("TC") unit for providing simultaneous independent temperature control of conditioned air to first and second rooms has been disclosed. The first TC unit generally includes: a cabinet; a first evaporator positioned within the cabinet and adapted to receive and exhaust air from and to, respectively, the first room so that so that the air from the first room passes through the first evaporator before exhausting back to the first room; and a second evaporator positioned within the cabinet and adapted to receive and exhaust air from and to, respectively, the second room so that the air from the second room passes through the second evaporator before exhausting back to the second room. In one or more embodiments, the first TC unit further includes a condenser positioned within the cabinet. In one or more embodiments, the condenser is adapted to receive and exhaust atmospheric air from and to, respectively, an exterior of a building containing the first and second rooms so that the atmospheric air passes through the condenser before exhausting back to atmosphere. In one or more embodiments, the first TC unit further includes a compressor positioned within the cabinet and adapted to circulate heat transfer medium to the first evaporator and the second evaporator. In one or more embodiments, the compressor is a two-stage compressor. In one or more embodiments, the first TC unit is or includes a vertical terminal air conditioning ("VTAC") unit.

A first method for providing simultaneous independent temperature control of conditioned air to first and second rooms using a temperature control ("TC") unit including a cabinet has also been disclosed. The first method generally includes: conveying air from the first room through a first evaporator positioned within the cabinet to thereby condition the air before exhausting the conditioned air back to the first room; and conveying air from the second room through a second evaporator positioned within the cabinet to thereby condition the air before exhausting the conditioned air back to the second room. In one or more embodiments, the first method further includes: circulating a heat transfer medium through a condenser positioned within the cabinet and the first evaporator; and circulating a heat transfer medium through the condenser and the second evaporator. In one or more embodiments, the first method further includes conveying atmospheric air from an exterior of a building containing the first and second rooms through the condenser before exhausting the atmospheric air back to atmosphere. In one or more embodiments, the first method further includes circulating, using a compressor positioned within the cabinet: a heat transfer medium through the first evaporator; and a heat transfer medium through the second evaporator. In one or more embodiments, the compressor is a two-stage compressor.

A first system for providing simultaneous independent temperature control of conditioned air to first and second rooms using a temperature control ("TC") unit including a cabinet has also been disclosed. The first system generally includes: a non-transitory computer readable medium; and a plurality of instructions stored on the non-transitory computer readable medium and executable by one or more processors, wherein, when the instructions are executed by the one or more processors, the following steps are executed: conveying air from the first room through a first evaporator positioned within the cabinet to thereby condition the air before exhausting the conditioned air back to the first room; and conveying air from the second room through a second evaporator positioned within the cabinet to thereby condition the air before exhausting the conditioned air back to the second room. In one or more embodiments, when the instructions are executed by the one or more processors, the following steps are also executed: circulating a heat transfer medium through a condenser positioned within the cabinet and the first evaporator; and circulating a heat transfer medium through the condenser and the second evaporator. In one or more embodiments, when the instructions are executed by the one or more processors, the following step is also executed: conveying atmospheric air from an exterior of a building containing the first and second rooms through the condenser before exhausting the atmospheric air back to atmosphere. In one or more embodiments, when the instructions are executed by the one or more processors, the following steps is also executed: circulating, using a compressor positioned within the cabinet: a heat transfer medium through the first evaporator; and a heat transfer medium through the second evaporator. In one or more embodiments, the compressor is a two-stage compressor.

A second temperature control ("TC") unit for providing simultaneous independent temperature control of conditioned air to first and second rooms has also been disclosed. The second TC unit generally includes: a cabinet divided into first and second compartments, the first compartment being adapted to receive and exhaust air from and to, respectively, the first room, and the second compartment being adapted to receive and exhaust air from and to, respectively, the second room. In one or more embodiments, the second TC unit further includes sound dampening insulation between the first compartment and the second compartment. In one or more embodiments, the first compartment extends along a top portion of the cabinet; and the second compartment also extends along the top portion of the cabinet, opposite the first compartment. In one or more embodiments, the second TC unit further includes: a first evaporator positioned within the first compartment so that the air from the first room passes through the first evaporator before exhausting back to the first room; and a second evaporator positioned within the second compartment so that the air from the second room passes through the second evaporator before exhausting back to the second room. In one or more embodiments, the cabinet is further divided into a third compartment. In one or more embodiments, the third compartment is adapted to receive and exhaust atmospheric air from and to, respectively, an exterior of a building containing the first and second rooms. In one or more embodiments, the second TC unit further includes sound dampening insulation between: the first compartment and the second compartment; the first compartment and the third compartment; the second compartment and the third compartment; or any combination thereof. In one or more embodiments, the third compartment extends along a bottom portion of the cabinet, opposite the first and second compartments. In one or more embodiments, the second TC unit further includes a condenser positioned within the third compartment. In one or more embodiments, the TC unit is or includes a vertical terminal air conditioning ("VTAC") unit.

A second method for providing simultaneous independent temperature control of conditioned air to first and second rooms using a temperature control ("TC") unit including a cabinet divided into first and second compartments has also been disclosed. The second method generally includes: receiving, into the first compartment, air from the first room; exhausting, out of the first compartment, conditioned air to the first room; receiving, into the third compartment, air from the second room; and exhausting, out of the third compartment, conditioned air to the second room. In one or more embodiments, the second method further includes dampening, using sound dampening insulation, a transmission of sound between the first compartment and the second compartment. In one or more embodiments, the first compartment extends along a top portion of the cabinet; and the second compartment also extends along the top portion of the cabinet, opposite the first compartment. In one or more embodiments, the second method further includes: conveying the air from the first room through a first evaporator positioned within the first compartment to thereby condition the air before exhausting the conditioned air back to the first room; and conveying the air from the second room through a second evaporator positioned within the second compartment to thereby condition the air before exhausting the conditioned air back to the second room. In one or more embodiments, the cabinet is further divided into a third compartment. In one or more embodiments, the second method further includes: receiving, into the third compartment, atmospheric air from an exterior of a building containing the first and second rooms; and exhausting, out of the third compartment, the atmospheric air to the exterior of the building. In one or more embodiments, the second method further includes dampening, using sound dampening insulation, a transmission of sound between: the first compartment and the second compartment; the first compartment and the third compartment; the second compartment and the third compartment; or any combination thereof. In one or more embodiments, the third compartment extends along a bottom portion of the cabinet, opposite the first and second compartments. In one or more embodiments, the second method further includes circulating a heat transfer medium through a condenser positioned within the third compartment.

A second system for providing simultaneous independent temperature control of conditioned air to first and second rooms using a temperature control ("TC") unit including a cabinet divided into first and second compartments has also been disclosed. The second system generally includes: a non-transitory computer readable medium; and a plurality of instructions stored on the non-transitory computer readable medium and executable by one or more processors, wherein, when the instructions are executed by the one or more processors, the following steps are executed: receiving, into the first compartment, air from the first room; exhausting, out of the first compartment, conditioned air to the first room; receiving, into the third compartment, air from the second room; and exhausting, out of the third compartment, conditioned air to the second room. In one or more embodiments, when the instructions are executed by the one or more processors, the following step is also executed: dampening, using sound dampening insulation, a transmission of sound between the first compartment and the second compartment. In one or more embodiments, the first compartment extends along a top portion of the cabinet; and the second compartment also extends along the top portion of the cabinet, opposite the first compartment. In one or more embodiments, when the instructions are executed by the one or more processors, the following steps are also executed: conveying the air from the first room through a first evaporator positioned within the first compartment to thereby condition the air before exhausting the conditioned air back to the first room; and conveying the air from the second room through a second evaporator positioned within the second compartment to thereby condition the air before exhausting the conditioned air back to the second room. In one or more embodiments, the cabinet is further divided into a third compartment. In one or more embodiments, when the instructions are executed by the one or more processors, the following steps are also executed: receiving, into the third compartment, atmospheric air from an exterior of a building containing the first and second rooms; and exhausting, out of the third compartment, the atmospheric air to the exterior of the building. In one or more embodiments, when the instructions are executed by the one or more processors, the following step is also executed: dampening, using sound dampening insulation, a transmission of sound between: the first compartment and the second compartment; the first compartment and the third compartment; the second compartment and the third compartment; or any combination thereof. In one or more embodiments, the third compartment extends along a bottom portion of the cabinet, opposite the first and second compartments. In one or more embodiments, when the instructions are executed by the one or more processors, the following step is also executed: circulating a heat transfer medium through a condenser positioned within the third compartment.

It is understood that variations may be made in the foregoing without departing from the scope of the present disclosure.

In one or more embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In one or more embodiments, while different steps, processes, and procedures are described as appearing as distinct acts, one or more of the steps, one or more of the processes, and/or one or more of the procedures may also be performed in different orders, simultaneously and/or sequentially. In one or more embodiments, the steps, processes, and/or procedures may be merged into one or more steps, processes and/or procedures.

In one or more embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A system for providing simultaneous independent temperature control of conditioned air to first and second rooms, the system comprising:

a compressor adapted to circulate a heat transfer medium;

a condenser;

a first flow path through which the compressor is adapted to circulate at least a first portion of the heat transfer medium, said first flow path comprising:

a first circuit of the condenser;

a first expansion valve;

a first evaporator through which air from the first room is adapted to pass before exhausting back to the first room; and a first circulation valve;

a second flow path through which the compressor is adapted to circulate at least a second portion of the heat transfer medium, said second flow path comprising a second circulation valve and/or a second circuit of the condenser, wherein, from an outlet of the first circuit of the condenser to an inlet of the first evaporator, the first and second flow paths are fluidically isolated from one another;

a first configuration, in which the first circulation valve is closed to prevent, or at least reduce, circulation of at least the first portion of the heat transfer medium from an outlet of the compressor and through the first flow path, including the first circuit of the condenser, the first expansion valve, and the first evaporator, and back to an inlet of the compressor; and a second configuration, in which the first circulation valve is open to permit circulation of at least the first portion of the heat transfer medium from the outlet of the compressor, through the first flow path, and back to the inlet of the compressor.

2. The system of claim 1, wherein:

atmospheric air is adapted to pass through the condenser, from an exterior of a building containing the first and second rooms, before exhausting back to atmosphere.

3. The system of claim 1, wherein the compressor is a two-stage compressor.

4. The system of claim 1, wherein:

the second flow path comprises:

the second circulation valve; and the second circuit of the condenser;

the second flow path further comprises:

a second expansion valve; and a second evaporator through which air from the second room is adapted to pass before exhausting back to the second room.

5. The system of claim 4, wherein the first and second circuits of the condenser extend in respective planes transversely to a direction in which air is adapted to pass through the condenser, said first and second circuits at least partially overlapping each other in their respective planes.

6. The system of claim 4, wherein:

in the first configuration, the second circulation valve is open to permit circulation of at least the second portion of the heat transfer medium from the outlet of the compressor, through the second flow path, including the second circuit of the condenser, the second expansion valve, and the second evaporator, and back to the inlet of the compressor.

7. The system of claim 6, wherein:

in the second configuration, the second circulation valve is open to permit circulation of at least the second portion of the heat transfer medium from the outlet of the compressor, through the second flow path, and back to the inlet of the compressor.

8. The system of claim 6, wherein:

in the second configuration, the second circulation valve is closed to prevent, or at least reduce, circulation of at least the second portion of the heat transfer medium from the outlet of the compressor, through the second flow path, and back to the inlet of the compressor.

9. A method for providing simultaneous independent temperature control to first and second rooms, the method comprising:

circulating, from an outlet of a compressor, at least a first portion of a heat transfer medium through a first flow path, including a first circuit of a condenser, a first expansion valve, a first evaporator, and a first circulation valve, and back to an inlet of the compressor;

exhausting air back to the first room after said air has passed from the first room and through the first evaporator;

closing the first circulating valve to prevent, or at least reduce, circulation of at least the first portion of the heat transfer medium from the outlet of the compressor, through the first flow path, and back to the inlet of the compressor; and circulating, from the outlet of the compressor, at least a second portion of the heat transfer medium through a second flow path, including a second circulation valve and/or a second circuit of the condenser, and back to the inlet of the compressor, wherein, from an outlet of the first circuit of the condenser to an inlet of the first evaporator, the first and second flow paths are fluidically isolated from one another.

10. The method of claim 9, further comprising:

exhausting air back to atmosphere after said air has passed from an exterior of a building containing the first and second rooms, and through the condenser.

11. The method of claim 9, wherein the compressor is a two-stage compressor.

12. The method of claim 9, wherein:

the second flow path includes:

the second circuit of the condenser; and the second circulation valve;

the second flow path further includes:

a second expansion valve; and a second evaporator;

and the method further comprises:

exhausting air back to the second room after said air has passed from the second room and through the second evaporator.

13. The method of claim 12, wherein the first and second circuits of the condenser extend in respective planes transversely to a direction in which air is adapted to pass through the condenser, said first and second circuits at least partially overlapping each other in their respective planes.

14. The method of claim 12, further comprising:

closing the second circulating valve to prevent, or at least reduce, circulation of at least the second portion of the heat transfer medium from the outlet of the compressor, through the second flow path, and back to the inlet of the compressor.

15. An apparatus for providing simultaneous independent temperature control to first and second rooms, the apparatus comprising:

a non-transitory computer readable medium; and a plurality of instructions stored on the non-transitory computer readable medium and executable by one or more processors to implement the following steps:

circulating, from an outlet of a compressor, at least a first portion of a heat transfer medium through a first flow path, including a first circuit of a condenser, a first expansion valve, a first evaporator, and a first circulation valve, and back to an inlet of the compressor;

exhausting air back to the first room after said air has passed from the first room and through the first evaporator;

closing the first circulating valve to prevent, or at least reduce, circulation of at least the first portion of the heat transfer medium from the outlet of the compressor, through the first flow path, and back to the inlet of the compressor; and circulating, from the outlet of the compressor, at least a second portion of the heat transfer medium through a second flow path, including a second circulation valve and/or a second circuit of the condenser, and back to the inlet of the compressor, wherein, from an outlet of the first circuit of the condenser to an inlet of the first evaporator, the first and second flow paths are fluidically isolated from one another.

16. The apparatus of claim 15, wherein:

the plurality of instructions stored on the non-transitory computer readable medium are executable by the one or more processors to implement the following additional step:

exhausting air back to atmosphere after said air has passed from an exterior of a building containing the first and second rooms, and through the condenser.

17. The apparatus of claim 15, wherein the compressor is a two-stage compressor.

18. The apparatus of claim 15, wherein:

the second flow path includes:

the second circuit of the condenser; and the second circulation valve;

the second flow path further includes:

a second expansion valve; and a second evaporator;

and the plurality of instructions stored on the non-transitory computer readable medium are executable by the one or more processors to implement the following additional step:

exhausting air back to the second room after said air has passed from the second room and through the second evaporator.

19. The apparatus of claim 18, wherein the first and second circuits of the condenser extend in respective planes transversely to a direction in which air is adapted to pass through the condenser, said first and second circuits at least partially overlapping each other in their respective planes.

20. The apparatus of claim 18, wherein:

the plurality of instructions stored on the non-transitory computer readable medium are executable by the one or more processors to implement the following additional step:

closing the second circulating valve to prevent, or at least reduce, circulation of at least the second portion of the heat transfer medium from the outlet of the compressor, through the second flow path, and back to the inlet of the compressor.

* * * * *